US006325158B1

(12) United States Patent
Rangnes et al.

(10) Patent No.: US 6,325,158 B1
(45) Date of Patent: Dec. 4, 2001

(54) METHOD AND DEVICE FOR MOUNTING OF A SEABED INSTALLATION

(75) Inventors: Atle Rangnes, Asker; Gunnar Bjøru, Kongsberg; Morten Backe, Drammen, all of (NO); Pete Aston, The Woodlands, TX (US)

(73) Assignee: Kongsberg Offshore A/S, Kongsberg (NO)

( * ) Notice: Subject to any disclaimer, the term of this patent is extended or adjusted under 35 U.S.C. 154(b) by 0 days.

(21) Appl. No.: 09/530,648

(22) PCT Filed: Oct. 30, 1998

(86) PCT No.: PCT/NO98/00326

§ 371 Date: Aug. 30, 2000

§ 102(e) Date: Aug. 30, 2000

(87) PCT Pub. No.: WO99/23350

PCT Pub. Date: May 14, 1999

(30) Foreign Application Priority Data

Nov. 3, 1997 (NO) ..... 975066

(51) Int. Cl.[7] ..... E21B 33/035; E21B 43/01

(52) U.S. Cl. ..... 175/5; 175/10; 166/338

(58) Field of Search ..... 166/338, 366, 166/342, 343, 360, 339, 356; 175/5, 7, 8, 10

(56) References Cited

U.S. PATENT DOCUMENTS 3,603,385 * 9/1971 Jones .
3,779,313 * 12/1973 Regan .
3,913,669 10/1975 Brun et al. .
4,039,025 * 8/1977 Burkhardt et al. .
4,126,183 * 11/1978 Walker .
4,154,552 * 5/1979 Van Bilderbeek .
4,167,215 9/1979 Thorne .
4,399,872 8/1983 McConaughy et al. .
4,832,124 * 5/1989 Davis .
4,893,677 1/1990 Brammer et al. .
5,722,796 3/1998 Halvorsen et al. .

FOREIGN PATENT DOCUMENTS 157747 2/1988 (NO) .
944545 11/1994 (NO) .
180758 3/1997 (NO) .
301555 11/1997 (NO) .
WO 9606260 A1 2/1996 (WO) .

* cited by examiner

*Primary Examiner*—Frank Tsay
(74) *Attorney, Agent, or Firm*—Young & Thompson

(57) ABSTRACT

A method for mounting a seabed installation including a drilling template and a manifold on a mooring device anchored to the seabed. The mooring device comprises an open guide boring. The drilling template and the manifold are arranged to be suspended separately on, and lowered by a string which extends from an offshore platform. The method includes lowering the manifold and inserting a connected guide post which projects down from the manifold, in a guide hole of the drilling template. Thereafter, interacting sections of the central guide post and the guide hole respectively are made to cause an alignment of the manifold in a fixed rotational position relative to the drilling template during the introduction and before the manifold comes into contact with the drilling template. Finally, the manifold is lowered relative to the guide post after the contact thereof in the guide hole. No use is made of guidelines which extend from the platform to the seabed.

4 Claims, 4 Drawing Sheets

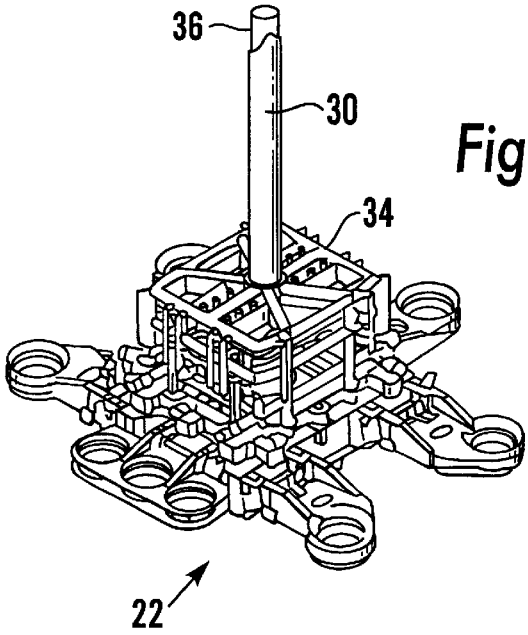
Fig.3
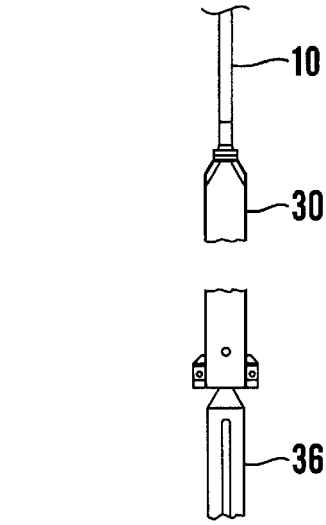
Fig.8
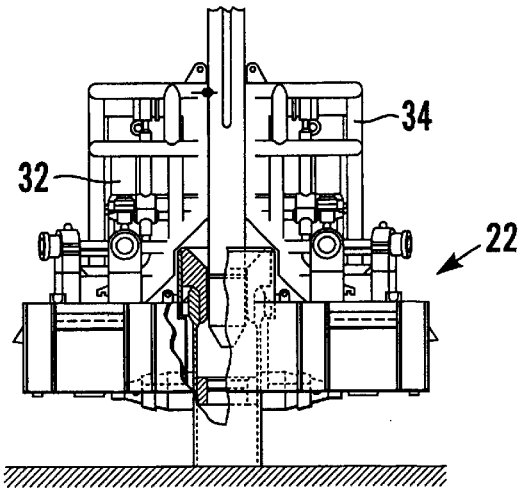

METHOD AND DEVICE FOR MOUNTING OF A SEABED INSTALLATION

CROSS REFERENCE TO RELATED APPLICATION

This is the 35 USC 371 national stage of International application PCT/NO98/00326 filed on Oct. 30, 1998, which designated the United States of America.

FIELD OF THE INVENTION

The invention relates to a method for mounting a seabed installation and to a device for implementing the method.

BACKGROUND OF THE INVENTION

In another application submitted simultaneously with this application by the same applicant, there is described a mooring device of the above-mentioned type, which comprises a suction anchor section, a casing and possibly a pile which is arranged for attachment to a seabed formation, the guide boring being provided in the guide pipe. This mooring device can be employed in bottom installations which are lowered and hereby guided by means of guidelines from a drilling platform to the mooring device, as well as in bottom installations which are lowered without the use of such lines.

Moreover, from the applicant's GB 2 285 274 (corresponding to Norwegian application no. 944545) there is known another similar device for a drilling template which is arranged for mounting by means of guidelines. This drilling template is suitable for use only at relatively shallow depths, i.e. depths of up to 500 m, since the use of guidelines at greater depths is associated with difficulties.

SUMMARY OF THE INVENTION

The object of the invention is to provide a device as indicated initially which is suitable for positioning without the use of guidelines, i.e. for positioning at great depths, e.g. at depths of between 500 m and 2500 m.

The characteristics of the device according to the invention are presented in the characteristic clause of the claims.

BRIEF DESCRIPTION OF THE DRAWINGS

The invention will now be described in more detail with reference to the drawing which schematically illustrates an embodiment of a device according to the invention.

FIG. 3 is a perspective view of a drilling template, a manifold and a protective frame which is mounted on a mooring device on the seabed.

FIG. 8 is a side view resembling that illustrated in FIG. 7, but where the tool has been released at the bottom from the protective frame and raised, with the result that the guide post is not located in the tool, where sections of the tool and the guide post have been cut away.

DETAILED DESCRIPTION OF THE INVENTION

Figure 1:
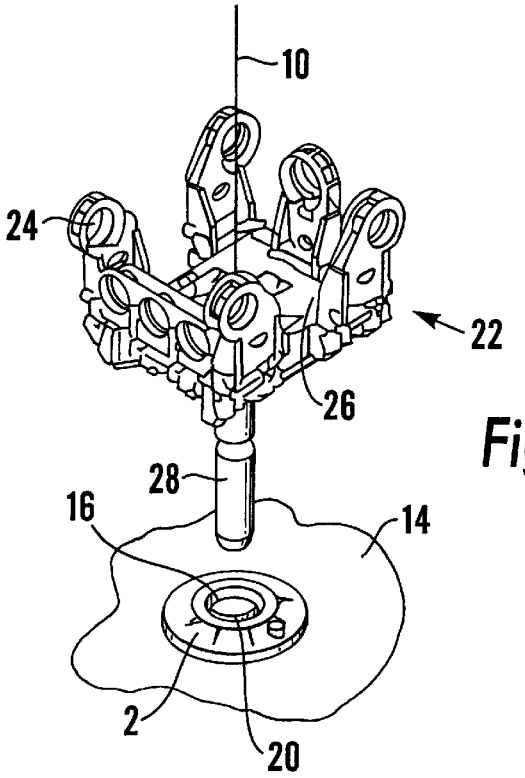
FIG. 1 is a perspective view of a drilling template which is located above a mooring device similar to that which is described in the above-mentioned application which was submitted by the applicant simultaneously with this application, where the drilling template is suspended in a drill string and side or wing elements of the drilling template have been pivoted upwards.

The direction "up" should be understood hereinafter as the direction towards the edge of the drawing facing away from the reader.

As illustrated in FIG. 1 there is provided on a seabed 14 a mooring device which is inserted in the seabed formation, and which comprises an upper suction anchor piece 2 with a central, vertically downwardly extending return cement guide pipe 16, wherein there extends an upwardly open boring 20.

To the lower end of a drill string 10 which is suspended in a platform at the surface of the sea (not shown) there is connected via a suitable coupling a drilling template 22 which comprises side or wing elements 24 which are pivotally connected to a central section 26, down from which there projects a central shaft or pile 28 which is adapted to the boring 20. The wing elements are arranged for use in connection with, e.g., drilling of wells by means of the drilling template, and in FIG. 1 are pivoted upwards, thus enabling the drilling template to be lowered through a cellar deck opening of the platform.

By means of appropriate manoeuvring from the platform in accordance with information provided by a remotely operated vehicle, hereinafter called a ROV, it can be achieved that the central pile 28 extends approximately coaxially above the boring 20, in which position the drill string 10 and thereby the drilling template 22 can be lowered, with the result that the central pile 28 is passed into the boring 20. By means of coacting alignment elements of the drilling template and the mooring device, e.g. cams and slots respectively, the drilling template can be aligned in the horizontal plane relative to the mooring device. The drilling template may further include a universal coupling which permits it to be aligned in such a manner that its central section 26 and the wing elements' turning axes extend horizontally. After the alignment the central pile 28 can be affixed to the boring 20 by means of cement.

The drill string is then released from the drilling template and by means of a suitable coupling attached to the upper end of a tubular tool 30 for positioning of a manifold 32 which is surrounded by a tubular or protective structure 34 for protection of the manifold against objects which inadvertently are moved towards the manifold. The lower end of the tool 30 is releasably attached to an upper central section of the manifold 32 and the protective structure 34.

Figure 2:
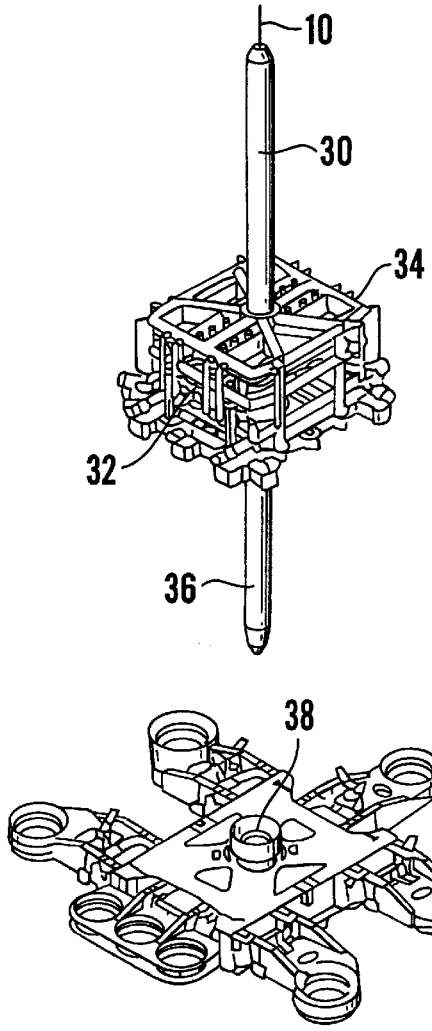
FIG. 2 is a perspective view of a manifold with a protective device, which is suspended in a drill string via a mounting tool above the drilling template, where the drilling template's wing elements have been pivoted down and project horizontally outwards.
Figure 4:
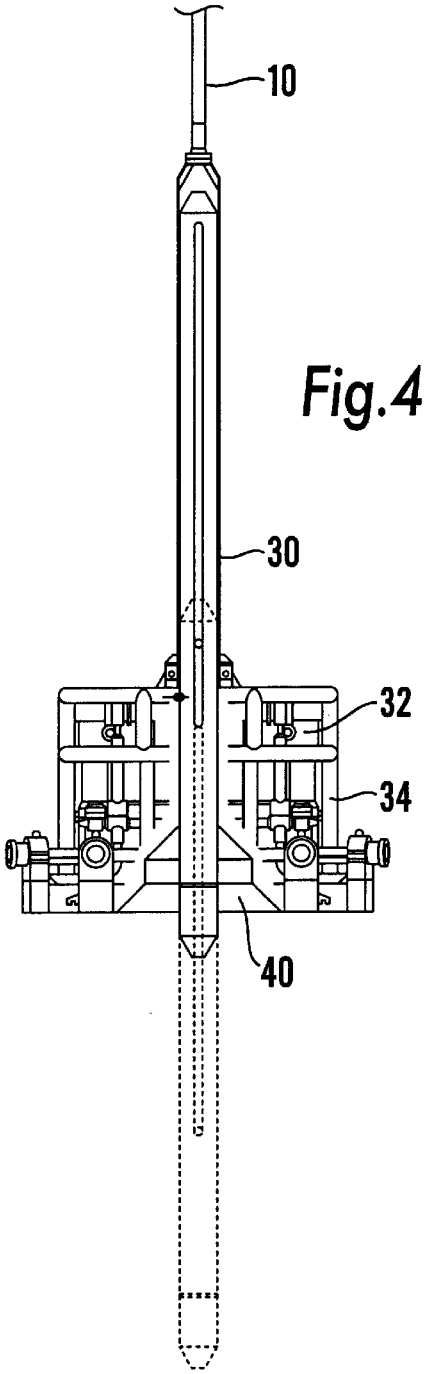
FIG. 4 is a side view of a manifold and a device for the protection thereof which are suspended in a drill string via a tubular suspension tool, into which a central guide post has been drawn.
Figure 5:
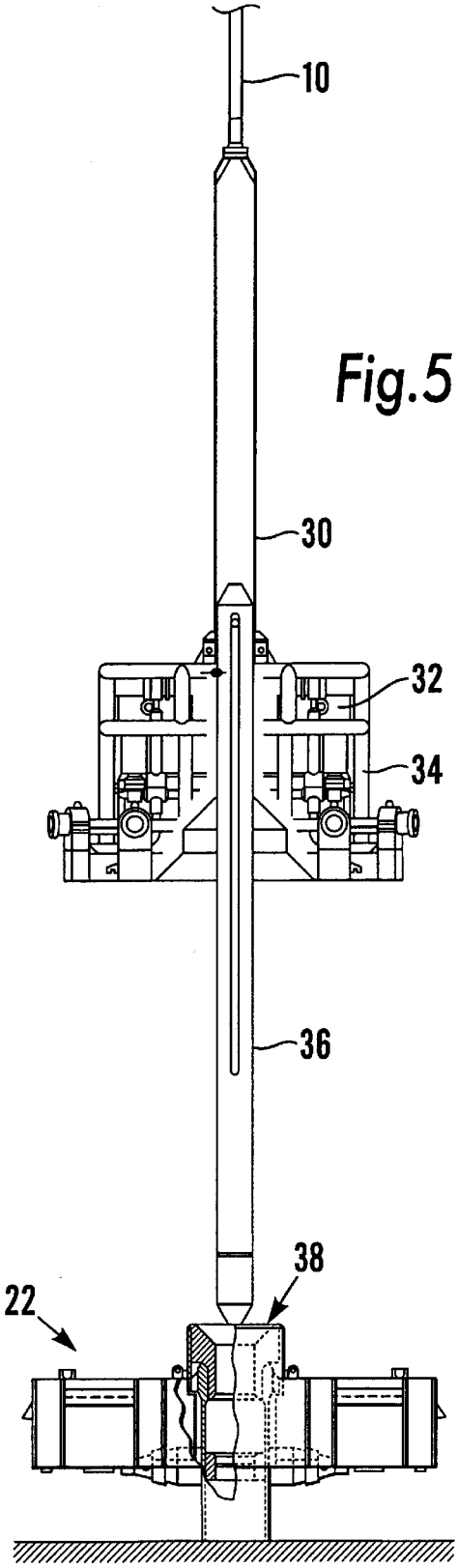
FIG. 5 is a side view resembling that illustrated in FIG. 4, but where the guide post is lowered relative to the tool and is located immediately above a drilling template.

Through a through-going hole in the manifold 32 and the protective structure 34 there extends axially movably, but not rotatably a central guide post 36, whose length may be greater than the length of the tool 30, and which, in the position of the manifold and the protective structure 34 which is illustrated in FIGS. 2 and 5 where the guide post 36 is retracted into the tool 30, extends coaxially out of the tool 30 and projects down from the manifold 32.

Figure 6:
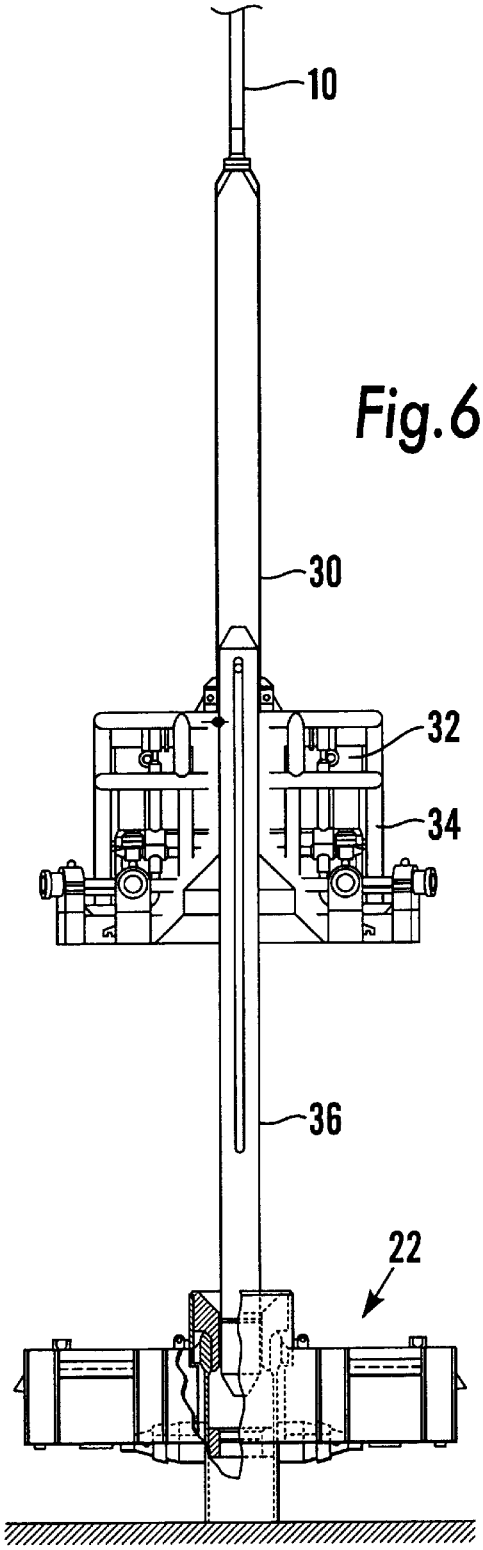
FIG. 6 is a side view resembling that illustrated in FIG. 5, but where the guide post's lower end section is inserted into a guide hole of the drilling template.

After the guide post has been caused to extend approximately coaxially with a central, upwardly facing guide hole 38 of the drilling template 22 by means of appropriate manoeuvring of the platform on being supplied with steering information thereto from a ROV, the manifold 32 and the protective device 34 are lowered while the guide post 36 is inserted in the guide hole 38, as illustrated in FIG. 6.

In order to achieve correct relative positioning of the manifold 32 and the drilling template 22, the guide post 36 and the guide hole 38 include interacting guide devices, e.g. cams and slots respectively, which can be brought into mutual engagement during the initial insertion of the guide post 36 in the guide hole 38, and which during the further lowering of the guide post 36 cause a rotation of the manifold 32 and the protective device relative to the drilling template 22, with the result that these components arrive at a fixed relative position viewed in a horizontal plane, i.e. in a vertical projection. It will be understood that an alignment of this kind can be achieved by means of many different alignment or guide devices.

Figure 7:
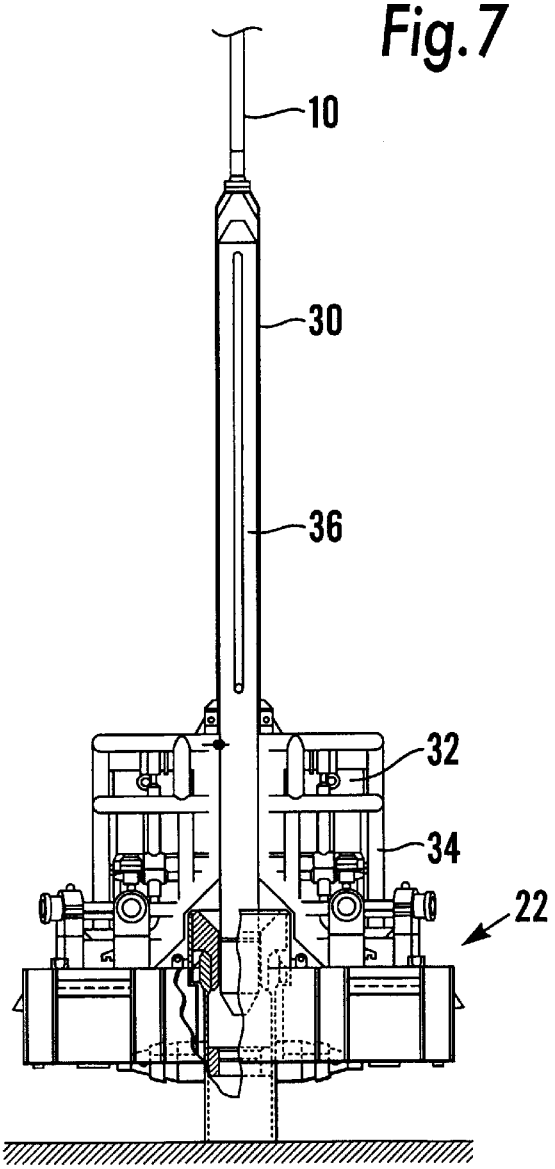
FIG. 7 is a side view resembling that illustrated in FIG. 6, but where the manifold and the protective device with the thereon mounted tool are lowered, with the result that the guide post is again located in an upper position relative to the tool, the manifold and the protective frame.

During a continued lowering of the drill string 10 the manifold 32 and the protective device are moved downwards relative to the drilling template 22 and the guide post 36 whose lower section abuts against contact sections of the guide hole 38, whereby the guide post 36 is inserted into the tubular tool 30 to the position which is illustrated in FIGS. 3 and 7.

Finally, the manifold 32 with the protective device 34 are locked to the central section 26 of the drilling template 22, and the tool 30 can be released from the manifold and the protective device, e.g. by means of a ROV and lifted away from the guide post 36 which now projects up from the manifold 32 and the protective device 34.

Any equipment which has to be attached to, e.g., the manifold, the protective device or the drilling template may be mounted in the correct position thereon, since the upwardly projecting guide post forms a guide device.

The drilling template and the manifold are now ready for drilling wells by guiding the drill string by means of the wing elements 24. On the drilling template there may be mounted, e.g., wellhead Christmas trees and retraction devices for pipes. The protective device may be released from the manifold and raised up to the platform by means of the tool 30, e.g. for repair if it has been damaged in an accident. The protective device may be employed as a landing place for a ROV by mounting appropriate means on these objects. Appropriate means may also be mounted on the protective device, thus enabling a ROV to be moved thereon for performing various operations in connection with, e.g., the manifold. Since the Christmas trees can be mounted independently of the manifold, they may be installed on the drilling template before the manifold.

What is claimed is:

1. Method for lowering, orienting and securing a manifold having a central hole on a seabed installation comprising a drilling template having a guide hole, a structure having an open boring and being anchored to the seabed; said guide hole, said boring and said central hole adapted to be brought into mutual alignment; and a pipe string arranged to be attached to the manifold for lowering said manifold towards the seabed installation, the method comprising:

releasably attaching a tubular tool to the manifold at its central hole and attaching the pipe string to the tubular tool; the tubular tool being aligned with the central hole;

inserting a telescopically movable guide rod in the tubular tool;

lowering the manifold towards the drilling template;

bringing the guide rod into alignment with the guide hole;

further lowering the manifold and inserting the guide rod into the guide hole;

orienting the manifold into a fixed angular position relative to the drilling template;

pushing the guide rod telescopically into the tubular tool;

connecting the manifold and the drilling template; and releasing the tubular tool from the manifold, and lifting the tubular tool away from the manifold with the pipe string.

2. The method according to claim 1, wherein the guide rod is brought into alignment with the guide hole by a remotely operated vessel.

3. A device for lowering, orienting and securing a manifold having a central hole on a seabed installation comprising a drilling template having a guide hole, a structure having an open boring and being anchored to the seabed; said guide hole, said boring and said central hole adapted to be brought into mutual alignment; and a pipe string arranged to be attached to the manifold for lowering said manifold towards the seabed installation, the device comprising:

a tubular tool for attaching the manifold to the pipe string;

a guide rod which is arranged to be inserted and telescopically moved relative to the tubular tool;

said guide rod being rotationally fixed relative to the tubular tool and relative to the manifold.

4. The device according to claim 3, wherein the drilling template comprises a stopper placed in said guide hole, and arranged to cause the guide rod to be pushed into the tubular tool when the manifold is lowered towards the drilling template.

* * * * *